US006161478A

United States Patent [19]

Katz

[11] Patent Number: 6,161,478

[45] Date of Patent: Dec. 19, 2000

[54] PRINTING CYLINDER ASSEMBLY

[75] Inventor: Sidney Katz, New City, N.Y.

[73] Assignee: The Holdrite Co., Inc., New City, N.Y.

[21] Appl. No.: 09/432,346

[22] Filed: Nov. 2, 1999

[51] Int. Cl.[7] ..... B41F 13/08

[52] U.S. Cl. ..... 101/375; 101/368

[58] Field of Search ..... 101/375, 379, 101/368; 492/31, 36, 7, 18

[56] References Cited

U.S. PATENT DOCUMENTS

| | | | |
|---|---|---|---|
| 1,807,637 | 6/1931 | Sachs | 101/375 |
| 2,849,192 | 8/1958 | Fairchild | 242/72 |
| 3,055,083 | 9/1962 | Stobi | 492/7 |
| 3,494,675 | 2/1970 | Hold et al. | 492/7 |
| 3,512,756 | 5/1970 | Cleland | 254/93 |
| 4,111,569 | 9/1978 | Mengel | 403/5 |
| 4,150,622 | 4/1979 | Stollenwerk et al. | 101/378 |
| 4,381,709 | 5/1983 | Katz | 101/375 |
| 4,383,483 | 5/1983 | Moss | 101/375 |
| 4,386,566 | 6/1983 | Moss | 101/375 |
| 4,407,199 | 10/1983 | Moss | 101/375 |
| 4,598,448 | 7/1986 | Schiel et al. | 492/7 |
| 4,794,858 | 1/1989 | Katz | 101/375 |
| 4,837,906 | 6/1989 | Mori et al. | 492/7 |
| 4,934,266 | 6/1990 | Fantoni | 101/375 |
| 5,507,228 | 4/1996 | Schulz | 101/375 |

*Primary Examiner*—John S. Hilten
*Assistant Examiner*—Anthony H. Nguyen
*Attorney, Agent, or Firm*—Abelman, Frayne & Schwab

[57] ABSTRACT

A printing cylinder assembly adapted to be removably supported on a hydraulically operable mandrel having means to hydraulically apply radially outward forces is disclosed. The printing cylinder assembly has a generally cylindrical coated printing cylinder having two open end portions, and a generally annular sleeve positioned within each end portion and in shrink fit relation therewith. Each annular sleeve has a generally annular groove therein and at a location which corresponds to the general location of application of the radially outward forces when the cylinder is positioned on the mandrel. Radially outward forces are hydraulically developed by the mandrels and are transmitted to the cylinder through the annular sleeves to retain the cylinder and the mandrel as an integral unit. The grooved portion of each annular sleeve defines two adjacent annular stepped portions wherein the grooved portion has a greater flexibility in the radial direction than the adjacent stepped portions. The grooved portion of the annular sleeves expands radially under the hydraulically developed expansion forces and redistributes the expansion forces through the stepped regions into the cylinder in a generally distributed manner. In the preferred embodiment the grooved portion and the two adjacent annular stepped regions define a cross-sectional profile having a generally rectangular outline while in an alternative embodiment, the grooved region has a generally dovetailed outline. Also, in the preferred embodiment the sleeve is received in a constant diameter bore while in an another embodiment the sleeve is received in an axially tapered opening. The cylinder coating in the preferred embodiment is an analox coating.

20 Claims, 3 Drawing Sheets

PRINTING CYLINDER ASSEMBLY

BACKGROUND OF THE INVENTION

1. Field of the Invention

The present invention relates generally to printing cylinders, and in particular, to a printing cylinder that is removably supported on a hydraulically expansible mandrel, whereby the cylinder can be damaged by forces exerted by the expanding mandrel.

2. Description of the Related Art

Printing rollers with removably supported printing cylinders are generally known. By way of example, one such printing roller is described in U.S. Pat. No. 4,381,709 which is fully incorporated herein by reference and made a part of this disclosure. As described in U.S. Pat. No. 4,381,709, an expandable sleeve located at each end of a printing mandrel radially expands as a result of application of hydraulic pressure to hold a printing cylinder in position relative to the mandrel. To remove the cylinder, the hydraulic pressure is removed and the cylinder is slidably removed from the mandrel.

Application of hydraulic pressure causes each sleeve to expand radially, with the maximum radial increase being at substantially the midpoint of each sleeve between its two axial ends. As the hydraulic pressure is increased, the maximum radius of the sleeve continues to increase, causing a circumferential and relatively concentrated interference fit between the sleeve and the cylinder, and a corresponding stress increase within the cylinder at the interference region. As the hydraulic pressure is changed, both the radial forces acting on the cylinder and the area over which the forces act undergo a change.

In prior art printing rollers, a steel cylinder was provided with a plurality of small holes to carry the ink. The holes were made by suitable machining processes, such as by knurling or the like. More recently, such cylinders have been made of lightweight, relatively thinwall steel construction to accommodate the addition of a coating suitable for printing applications. One of the coatings which is used is generally described as an "analox" coating which is a relatively smooth, but delicate ceramic material which is layered on the outer surface of the steel cylinder. The analox coating is generally applied directly to the outer surface of the cylinder and is highly polished, then ground and laser etched to form a multiplicity of small ink carrying holes. When the cylinder surface is inked and the excess ink is wiped off the cylinder, the ink carried in the small holes is used to provide the precision printing. Other coating materials are contemplated.

It has been found that the substantial hydraulic forces exerted on the cylinder by the hydraulically operable mandrel can cause cylinder stresses that can undesirably deform the cylinder and crack the relatively brittle outer analox coating on the cylinder.

U.S. Pat. Nos. 4,407,199, 4,386,566 and 4,383,483 to Moss disclose removably supported printing cylinders having attached thick end reinforcing rings grippable by mandrel mounted expansion sleeves. Radial forces from the expansion sleeves are received by the thick reinforcing rings. U.S. Pat. No. 4,794,858 to Katz discloses a pneumatic release mandrel for the support of a printing cylinder. U.S. Pat. No. 5,507,228 to Schultz discloses a removably supported printing cylinder without reinforcing rings. The patent shows a single full length expansion sleeve having grooves cut into each end to facilitate expansion of the sleeve region between the grooves. The sleeve is sealingly attached to the mandrel. U.S. Pat. Nos. 4,934,266 to Fantoni also shows a single full length expansion sleeve as an integral part of a mandrel.

I have invented a printing cylinder assembly which incorporates a coated relatively lightweight printing cylinder supported on a mandrel in a manner which avoids the development of damaging forces to the outer surface of the cylinder.

SUMMARY OF THE INVENTION

A printing cylinder assembly adapted to be removably supported on a hydraulically operable mandrel, and having means to hydraulically apply radially outward forces through expansion sleeves is disclosed. The printing cylinder assembly comprises a generally cylindrical coated printing cylinder having two end portions, and at least one generally annular sleeve positioned within each end portion and attached by a shrink fit connection therebetween. Each annular sleeve has a generally annular groove therein at a location which corresponds to the general location of application of radially outward forces when the cylinder is positioned on the mandrel and the hydraulically developed attachment forces are applied by the mandrel. The radially outward forces are generated by hydraulic pressure acting on the expansion sleeves and transmitted to the cylinder through circumferential contact with the annular sleeve to retain the cylinder and the mandrel as an integral unit.

The grooved portion of the sleeve defines two adjacent annular stepped portions such that the grooved portion has a greater flexibility in the radial direction than the adjacent stepped portions. The grooved portion of the annular sleeve receives and accommodates the expansion of the expansion sleeve in the radial direction and thereby redistributes the expansion forces through the stepped regions to the cylinder. The annular groove allows radial expansion of the grooved portion in cooperation with the expansion sleeve of the cylinder assembly, but is dimensioned to prevent contact between the grooved portion and the cylinder. In the preferred embodiment the grooved portion and the two adjacent annular stepped regions define a cross-sectional profile having a generally rectangular outline. In an alternative embodiment, the grooved region has a generally dovetailed outline.

Preferably the groove in each annular sleeve has a generally rectangular cross-section in a plane extending through a longitudinal axis of the cylinder. For example, an annular sleeve of length of about 2.5 inches and a diameter about 4.0 inches will have an annular groove about 1.25 inches in length and about 0.030 inches in depth. Such groove will generally undergo a maximum outward radial deflection of approximately 0.008 inches when the normal hydraulic pressures are applied. However, such dimensions are exemplary only. It should be emphasized that the dimensions of the annular sleeve and the groove will vary in dependence upon the dimensions of the printing cylinder, the mandrel and the hydraulic forces applied in each circumstance.

Further, in the preferred embodiment the sleeve is received in a constant diameter bore, while in an another embodiment the sleeve is received in an axially tapered opening.

The cylinder coating in the preferred embodiment is an analox coating.

BRIEF DESCRIPTION OF THE DRAWINGS

Preferred embodiments of the invention are described hereinbelow with reference to the drawings, wherein.

DESCRIPTION OF THE PREFERRED EMBODIMENTS

As used herein, numerals in the range from 10–18 designate elements of a prior art apparatus; numerals in the range 20–90 designate elements of an embodiment of the apparatus according to the present invention; and numerals in the range 120–190 designate elements of an alternative embodiment of the apparatus according to the present invention, and wherein the numeral designation of like elements of different embodiments of the apparatus of the present invention differ by 100.

Figure 1:
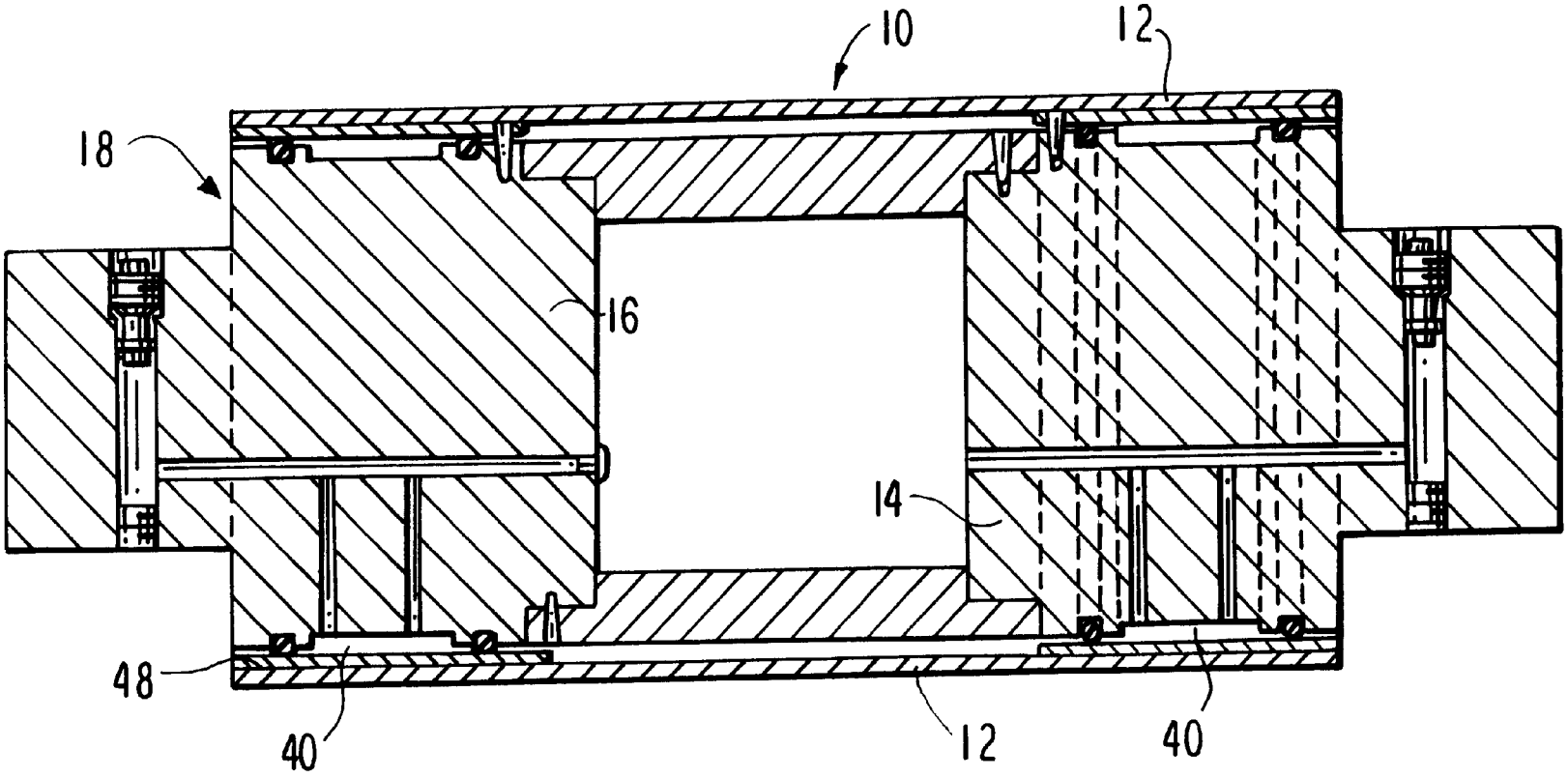
FIG. 1 PRIOR ART
FIG. 1 is an elevational cross-sectional view of a printing roller assembly disclosed in U.S. Pat. No. 4,381,709.

Referring initially to FIG. 1, there is illustrated an elevational cross-sectional view of a printing roller assembly disclosed in U.S. Pat. No. 4,381,709. Generally, the printing roller assembly 10 includes an outer cylinder 12 mounted on a mandrel 18. The mandrel 18 includes outer end journals 14 and 16 which are adapted to receive hydraulic pressure in annular chambers 15 and transmit resultant radial forces via sleeves 17 to retain the mandrel 18 and outer printing cylinder 12 as an integral unit. The details of the structure and operation of the printing roller assembly are fully described in U.S. Pat. No. 4,381,709 which is fully incorporated herein by reference and made a part of this disclosure.

Figure 2:
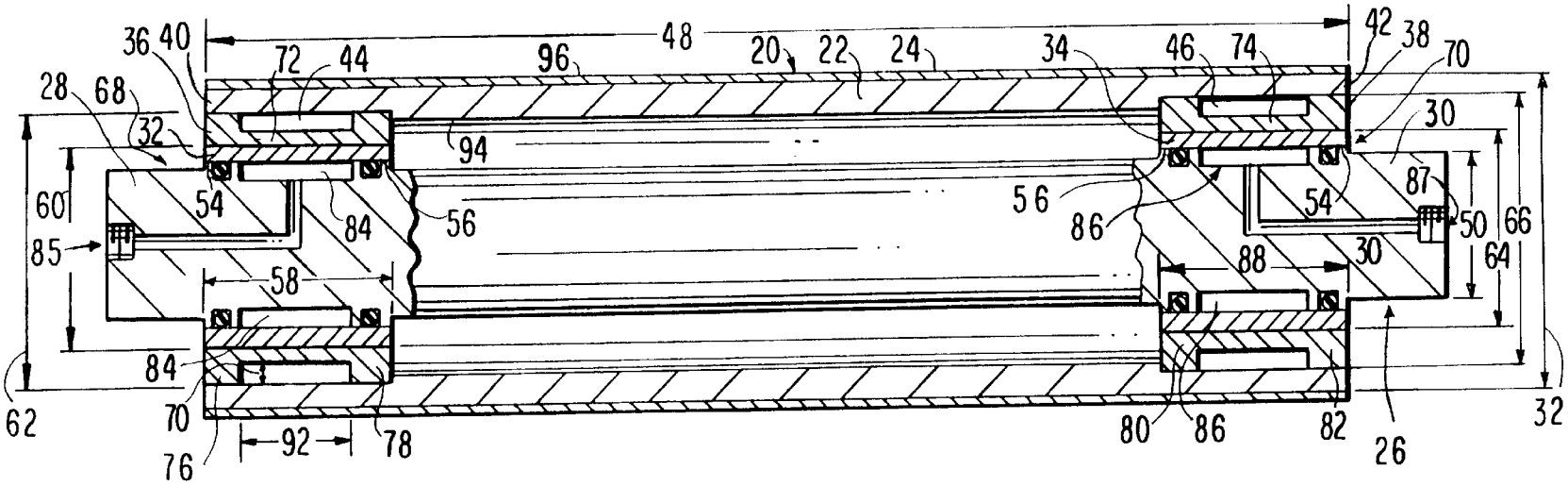
FIG. 2 is an elevational cross-sectional view of a printing roller assembly including a printing cylinder assembly constructed in accordance with the present invention and mounted on a hydraulically operable mandrel.

Referring now to FIG. 2 there is illustrated an elevational cross-sectional view of a printing cylinder assembly 20 which is constructed in accordance with the present invention. The printing cylinder assembly 20 includes outer cylinder 22 having an analox coating 24 which is intended for uses well known in the printing art. The cylinder assembly 20 is mounted on mandrel 26 which includes outer end journals 28 and 30 adapted for hydraulic pressurization of annular chambers 84 and 86 through hydraulic systems 85 and 87. Sleeves 32 and 34 on end journals 28 and 30 receive hydraulic pressure and radially expand in a manner similar to that disclosed for the printing roller system described in U.S. Pat. No. 4,381,709.

Referring again to FIG. 2, the present cylinder assembly includes sleeves 36 and 38 respectively positioned between sleeves 32 and 34 and cylinder 22 to assist in transmitting forces developed by the hydraulic system to the cylinder 22. Sleeves 36 and 38 are constructed as shown and include annular grooves 44 and 46. The sleeves 36 and 38 are preferably fabricated by machining annular grooves 44 and 46 in hollow cylindrical sections of spring steel having inner diameters 60, 64 and outer diameters 62, 66 which are substantially uniform over their lengths. The inner diameters 60 and 64 are dimensioned for slidable installation over sleeves 32 and 34 when not pressurized and the diameters 62 and 66 are dimensioned for shrink fit reception into conforming uniform diameter cylindrical end bores 68 and 70 in cylinder 22. Sleeves 36, 38 include respective deflection sections 72, 74 to accommodate the radial expansion of sleeves 32 and 34 and circumferential end steps 76, 78, 80 and 82 for distributing forces from expansion sleeves 32 and 34 into the end bores 68 and 70 and thereafter to cylinder 22. It will be recognized by those skilled in the art that other appropriate methods, i.e. a press fit, may also be used for receiving the sleeve into the cylinder end bore without deviating from the spirit of the invention.

Figure 3:
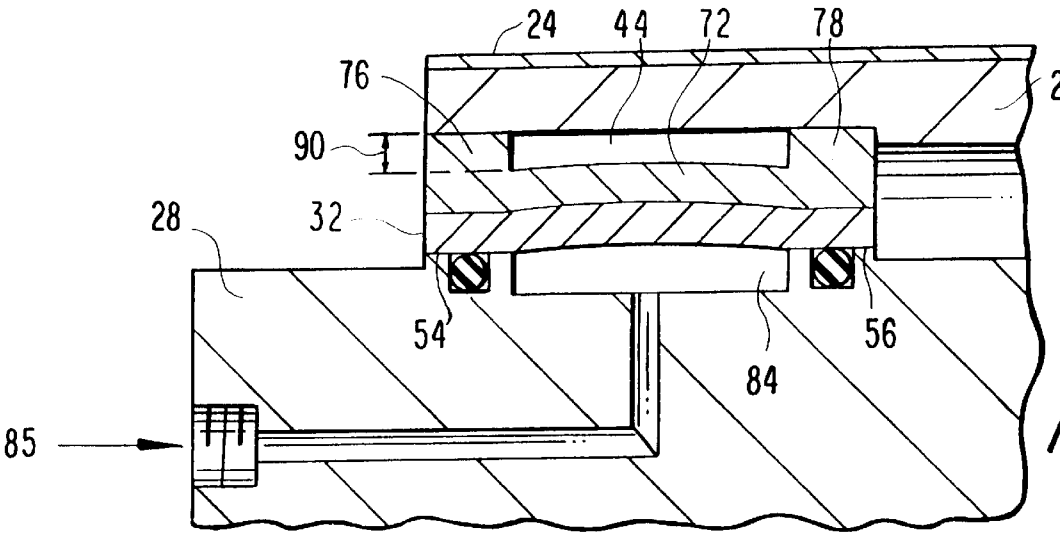
FIG. 3 is an enlarged cross-sectional view of the upper left-hand region of the printing roller assembly of FIG. 2, showing the sleeve deflection effects produced by application of hydraulic pressure by the mandrel.

Referring now to FIG. 3, there is illustrated an enlarged cross-sectional view of the upper left-hand region of FIG. 2 showing the effects of the application of hydraulic pressure to the sleeves.

Increasing hydraulic pressure in annulus 84 causes increasing outward radial forces on sleeve 32, which results in radial expansion of the sleeve 32 as shown in FIG. 3. In general, it is believed that the maximum radial increase is located at substantially the axial midpoint of the sleeve 32, and such pressure results in a circumferential and generally concentrated interference relation with deflection section 72. Deflection section 72 deforms to receive the expansion of sleeve 32, but protects cylinder 22 since deflection section 72 does not contact cylinder 22. Outward radial forces exerted on deflection section 72 are redirected into end steps 76 and 78 and diffused into cylinder 22 through the shrink fit attachment of end steps 76 and 78, and thereby to cylinder 22. In one preferred embodiment of the invention, an outward radial deflection of deflection section 72 can be approximately 0.008 inches for a sleeve having a groove of rectangular cross-section, and a groove depth 90 of approximately 0.030 inches.

Figure 4:
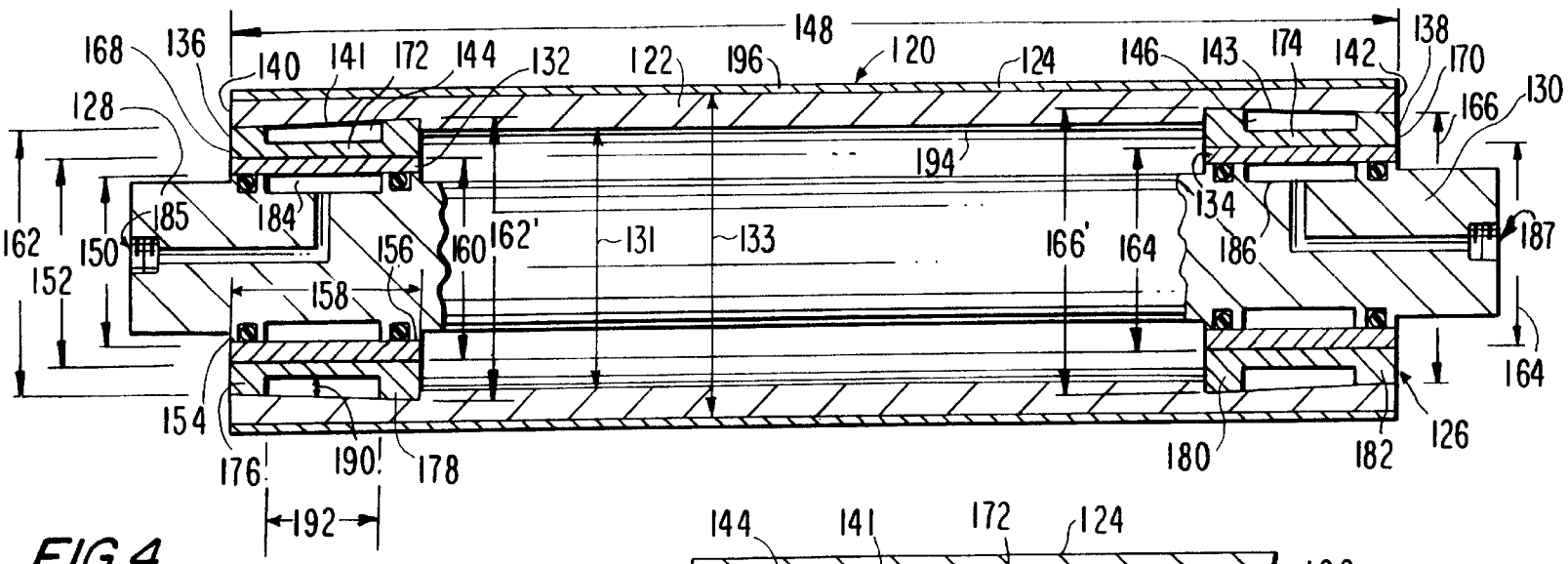
FIG. 4 is an elevational cross-sectional view of a printing roller assembly including a printing cylinder constructed in accordance with an alternative embodiment of the present invention and mounted on a mandrel.
Figure 5:
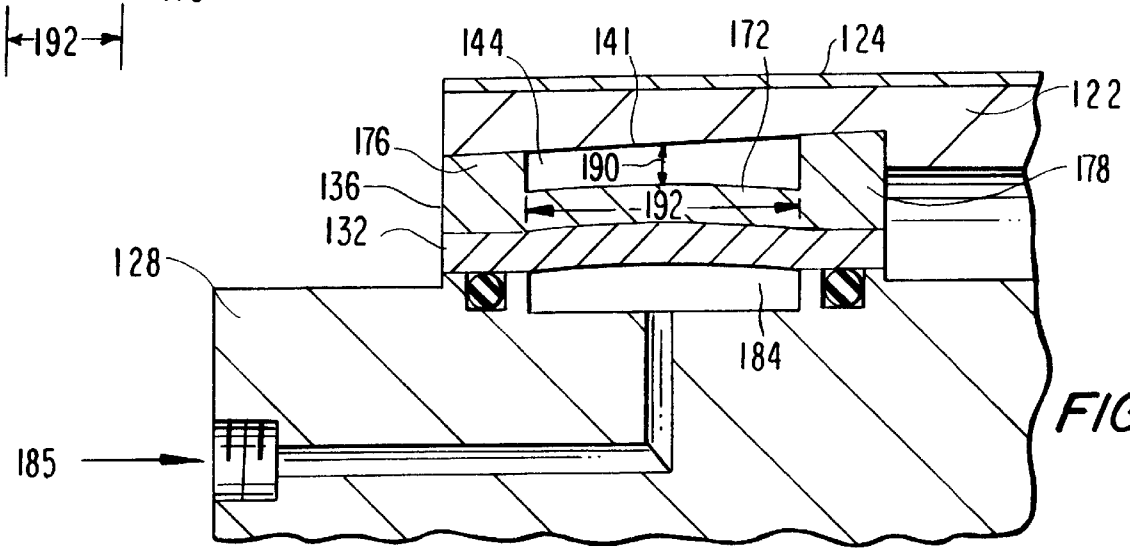
FIG. 5 is an enlarged cross-sectional view of the upper left-hand region of the printing roller assembly of FIG. 4 showing the sleeve deflection effects produced by application of hydraulic pressure.

Referring now to FIG. 4 there is shown an elevational cross-sectional view of a printing cylinder assembly 120 constructed in accordance with an alternative embodiment of the invention. The assembly 120 includes cylinder 122, tapered sleeves 136 and 138 and conforming tapered openings 141 and 143. The cylinder assembly 120 is slidably mounted on mandrel 126, which is substantially identical in form, fit and function to mandrel 26 shown in FIG. 2 and described in connection therewith. In this embodiment, however, the sleeves 136 and 138 are tapered as shown, and include annular grooves 144 and 146 fabricated by machining the grooves into hollow tapered sections of spring steel having inner diameters 160 and 164 respectively. The tapered sleeves 136 and 138 are received in cylinder 122 in shrink-fit relation to conforming openings 141 and 143 so that deflection sections 172 and 174 and end steps 176, 178, 180 and 182 operate in the same protective manner as deflection sections 72 and 74 and end steps 76, 78, 80 and 82 of the preferred embodiment shown in FIGS. 3 and 4.

It should be noted that in the preferred embodiment shown in FIG. 2 the cross-sectional view of groove 44 includes a generally rectangular profile; in FIG. 4, except for the slight taper, the groove is also somewhat rectangular in cross-section. Other cross-sectional configurations for the grooves can be used, provided that the deflection sections such as 72, 74, 172, 174 are retained. For example, a dovetail-like profile (not shown) wherein the axial length 92 of a groove 44 is shorter adjacent to bore 68 and longer adjacent to deflection section 72 can be utilized. This alternative embodiment provides for greater contact areas between end steps and their cooperating bores, and can result in lower cylinder stress levels.

Although the invention has been described in detail with reference to the illustrated preferred embodiments, variations and modifications may be provided within the scope and spirit of the invention as described by these following claims.

What is claimed is:

1. A printing cylinder assembly (20), comprising:

a) an outer cylinder (22), having a uniformly circular cross section with an inner diameter (31) and an outer diameter (33), a pair of opposite first and second ends (40,42), and an elongate portion with a fixed length (48) between the first and second ends (40,42), an inner surface area (94), and an outer surface area (96), the outer cylinder (22) being hollow and open at each of the first and second ends (40,42), with a first end bore (68) in the first end (40), and a second end bore (70) in the second end (42);

b) a pair of first and second outer end journals (28,30), with the first end journal (28) being attached to and positioned within the first end (40) of the outer cylinder (22) and the second end journal (30) being attached to and positioned within the second end (42) of the outer cylinder (22);

c) a pair of first and second hydraulically pressurizable annular chambers (84,86), with the first annular chamber (84) being positioned in the first end journal (28) and the second annular chamber (86) being positioned in the second end journal (30);

d) a pair of first and second hydraulic systems (85,87), for hydraulically pressurizing the annular chambers (84, 86), such that the first hydraulic system (85) is positioned in the first end journal (28) and is in fluid communication with the first annular chamber (84), and the second hydraulic system (87) is positioned in the second end journal (30) and is in fluid communication with the second annular chamber (86);

e) a pair of radially expansible first and second inner sleeves (32,34), the first and second inner sleeves (32,34) each having a uniformly circular cross section with an inner diameter (50) and an outer diameter (52), a pair of opposite first, outer (54) and second, inner (56) ends, and an elongate portion with a fixed length (58) between the first and second ends (54,56), with the lengths (58) of the elongate portions of each of the first and second inner sleeves (32,34) being individually and collectively less than the length (48) of the elongate portion of the outer cylinder (22); with the first and second inner sleeves (32,34) being hollow and open at each of their respective first and second ends (54,56), with the outer diameter of the first and second inner sleeves (32,34) being less than the inner diameter of the outer cylinder (22), such that the first inner sleeve (32) is positioned inside the outer cylinder (22) at the first end of the outer cylinder (22), so as to be in communication with the first annular chamber (84), and the second inner sleeve (34) is positioned inside the outer cylinder (22) at the second end of the outer cylinder (22), so as to be in communication with the second annular chamber (86); with the first and second inner sleeves (32,34) being outwardly radially expansible from a first, non-expanded condition to a second, expanded condition;

such that when the first hydraulic system (85) is actuated to hydraulically pressurize the first annular chamber (84), a resulting pressure is transmitted to the first inner sleeve (32), while in an unexpanded condition, thereby causing it to expand radially outward; and when the second hydraulic system (87) is actuated to hydraulically pressurize the second annular chamber (86), a resulting pressure is transmitted to the second inner sleeve (34), while in an unexpanded condition, thereby causing it to expand radially outward; and f) a pair of first and second middle sleeves (36,38), the first and second middle sleeves (36,38) each having a uniformly circular cross section with an inner diameter (60,64) and an outer diameter (62,66), a pair of opposite first, outer (96) and second, inner (98) ends, and an elongate portion with a fixed length (88), between the first and second ends, with the first and second middle sleeves (36,38) being hollow and open at each of their respective first and second ends, with the inner diameter (60,64) of the respective middle sleeves (36,38) being greater than the outer diameter of the first and second inner sleeves (32,34) and the outer diameter (62,66) of the respective middle sleeves (36,38) being less than the inner diameter (31) of the outer cylinder (22), such that the first middle sleeve (36) is positioned over the first inner sleeve (32) and inside the outer cylinder (22), at the first end of the outer cylinder (22); the second middle sleeve (38) is positioned over the second inner sleeve (34) and inside the outer cylinder (22), at the second end of the outer cylinder (22); and the lengths (88) of the elongate portions of each of the first and second middle sleeves (36,38) are individually and collectively less than the length (48) of the elongate portion of the outer cylinder (22);

with the first and second middle sleeves (36,38) each further having a respective first and second annular groove (44,46) on an outer surface thereof, proximate to the outer cylinder (22), with each of the first and second annular grooves (44,46) having a length (92) parallel to an axial length of the first and second middle sleeves (36,38), and a depth (90) transverse to the axial length of the first and second middle sleeves (36,38);

with the first and second middle sleeves (36,38) each still further having a respective deformable first and second deflection section (72,74), with the first deflection section (72) being positioned on the first middle sleeve (36) proximate to the first annular groove (44) on the outer surface of the first middle sleeve (36), between the first annular groove (44) and the first inner sleeve (32), and with the second deflection section (74) being positioned on the second middle sleeve (38) proximate to the second annular groove (46) on the outer surface of the second middle sleeve (38), between the second annular groove (46) and the second inner sleeve (34), the deflection sections (72,74) acting to respectively receive the first and second inner sleeves (32,34) during radial expansion thereof and deform in response thereto to prevent radially outward expansive forces from the first and second inner sleeves (32,34) from being transmitted to the cylinder (22), and with the first and second middle sleeves (36,38) each yet still further having one of a respective first and second pair of first and second circumferential end steps (76,78;80,82), with the first pair of end steps (76,78) forming part of the first middle sleeve (36), such that the first pair of end steps (76,78) is defined by the first annular groove (44), and such that the first end step (76) of the first pair is at the first, outer end of the first middle sleeve (36) and the second end step (78) of the first pair is at the second, inner end of the first middle sleeve (36), with the first deflection section (72) therebetween, and with the second pair of end steps (80,82) forming part of the second middle sleeve (38), such that the second pair of end steps is defined by the second annular groove (46), and such that the second end step (80) of the second pair is at the first, outer end of the second middle sleeve (38) and the second end step (82) of the second pair is at the second, inner end of the second middle sleeve (38), with the second deflection section (74) therebetween, such that the first pair of end steps (76,78) act to redirect outwardly radial forces transmitted thereinto by the first deflection section (72) into the cylinder (22), and the second pair of end steps (80,82) act to redirect outwardly radial force transmitted thereinto by the second deflection section (74) into the cylinder (22), during radial expansion of the first and second inner sleeves (32,34).

2. The printing cylinder assembly (20) according to claim 1, further comprising a hydraulically operable mandrel (26), capable of being detachably attached to the outer cylinder (22) by insertion into the first and second inner sleeves (32,34), whereby the mandrel (26) generates hydraulically developed attachment forces which actuate the hydraulic systems (85,87), thereby causing expansion of the first and second inner sleeves (32,34), deformation of the deflection sections (72,74) and transmission of the radially outward expansion forces of the first and second inner sleeves (32,34) into the end steps (76,78:80,82) and ultimately to the outer cylinder (22), which is thereby engaged and held to the mandrel (26), as long as the mandrel (26) continues to generate hydraulic attachment forces.

3. The printing cylinder assembly (20) according to claim 1, wherein the outer cylinder (22) has an analox coating (24) on the outer surface thereof.

4. The printing cylinder assembly (20) according to claim 1, wherein the first and second annular grooves (44,46), respectively in the first and second middle sleeves (36,38), have a higher flexibility in a radial direction transverse to a longitudinal axis along the lengths of the first and second middle sleeves (36,38), than in a direction along the longitudinal axis.

5. (New) The printing cylinder assembly (20) according to claim 1, wherein the first and second annular grooves (44,46), respectively in the first and second middle sleeves (36,38), have a higher flexibility in a radial direction transverse to the lengths of the first and second middle sleeves (36,38), than a flexibility in a radial direction of the respectively corresponding first and second pairs of first and second end steps (76,78;80,82), at either end of each of the first and second ends of the first and second middle sleeves (36,38).

6. The printing cylinder assembly (20) according to claim 1, wherein the first and second annular grooves (44,46), respectively in the first and second middle sleeves (36,38), and the first and second pairs of first and second end steps (76,78;80,82), at either end of each of the first and second ends of the first and second middle sleeves (36,38), have a rectangular cross section in a plane extending through a longitudinal axis along the lengths of the first and second middle sleeves (36,38).

7. The printing cylinder assembly (20) according to claim 1, wherein the first middle sleeve (36) is positioned inside the cylinder (22) in a shrink-fit reception with the inner surface of the cylinder (22), at the first end of the cylinder; and the second middle sleeve (38) is positioned inside the cylinder (22) in a shrink-fit reception with the inner surface of the cylinder (22), at the second end of the cylinder.

8. The printing cylinder assembly (20) according to claim 1, wherein the first and second middle sleeves (36,38) are made from spring steel.

9. The printing cylinder assembly (20) according to claim 1, wherein the first and second middle sleeves (36,38) each have an axial length (88) of about 2.5 inches and an inside diameter (60,64) of about 4.0 inches; and the first and second annular grooves (44,46) have a length (92) of about 1.25 inches and a depth (90) of about 0.03 inch.

10. The printing cylinder assembly (20) according to claim 9, wherein the first and second deflection sections (72,74) undergo a maximum outward radial deformation of about 0.008 inch.

11. A printing cylinder assembly (120), comprising:

a) an outer cylinder (122), having a uniformly circular cross section with an inner diameter (131) and an outer diameter (133), a pair of opposite first and second ends (140,142), and an elongate portion with a fixed length (148) between the first and second ends (140,142), an inner surface area (194), and an outer surface area (196), the outer cylinder (122) being hollow and open at each of the first and second ends (140,142), with a first end bore (168) in the first end (140), and a second end bore (170) in the second end (142);

b) a pair of first and second outer end journals (128,130), with the first end journal (128) being attached to and positioned within the first end (140) of the cylinder (122) and the second end journal (130) being attached to and positioned within the second end (142) of the cylinder (122);

c) a pair of first and second hydraulically pressurizable annular chambers (184,186), with the first annular chamber (184) being positioned in the first end journal (128) and the second annular chamber (186) being positioned in the second end journal (130);

d) a pair of first and second hydraulic systems (185,187), for hydraulically pressurizing the annular chambers (184,186), such that the first hydraulic system (185) is positioned in the first end journal (128) and is in fluid communication with the first annular chamber (184), and the second hydraulic system (187) is positioned in the second end journal (130) and is in fluid communication with the second annular chamber (186);

e) a pair of radially expansible first and second inner sleeves (132,134), the first and second inner sleeves (132,134) each having a uniformly circular cross section with an inner diameter (150) and an outer diameter (152), a pair of opposite first, outer (154) and second, inner (156) ends, and an elongate portion with a fixed length (158) between the first and second ends (154, 156), with the lengths (158) of the elongate portions of each of the first and second inner sleeves (132,134) being individually and collectively less than the length (148) of the elongate portion of the cylinder (122); with the first and second inner sleeves (132,134) being hollow and open at each of their respective first and second ends (154,156), with the outer diameter (152) of the first and second inner sleeves (132,134) being less than the inner diameter (131) of the cylinder (122), such that the first inner sleeve (132) is positioned inside the cylinder (122) at the first end of the cylinder (122), so as to be in communication with the first annular chamber (184), and the second inner sleeve (134) is positioned inside the cylinder (122) at the second end of the cylinder (122), so as to be in communication with the second annular chamber (186); with the first and second inner sleeves (132,134) being outwardly radially expansible from a first, non-expanded condition to a second, expanded condition;

such that when the first hydraulic system (185) is actuated to hydraulically pressurize the first annular chamber (184), a resulting pressure is transmitted to the first inner sleeve (132), while in an unexpanded condition, thereby causing it to expand radially outward; and when the second hydraulic system (187) is actuated to hydraulically pressurize the second annular chamber (186), a resulting pressure is transmitted to the second inner sleeve (134), while in an unexpanded condition, thereby causing it to expand radially outward; and f) a pair of first and second tapered middle sleeves (136,138), the first and second tapered middle sleeves (136,138) each having a frusto-conical configuration with a circular cross-sectional area, and having a circular top with a first inner diameter (160,164) and a first outer diameter (162,166) at a first, outer end (196) of each tapered middle sleeve (136,138); a circular bottom with a second inner diameter (160',164') greater than the first inner diameter (160, 164), and a second outer diameter (162',166') greater than the first outer diameter (162,166) at a second, inner end (198) of each tapered middle sleeve (136,138), and a tapered cylindrical side portion with a fixed length (188) between the first and second ends (196,198), with the first and second tapered middle sleeves (136,138) being hollow and open at each of their respective first and second ends (196,198), with both the first and second inner diameters (160,164; 160',164') of the respective first and second ends of the first and second tapered middle sleeves (136,138) being greater than the outer diameter (152) of the first and second inner sleeves (132,134); and both the first and second outer diameters (162, 166;162',166') of the respective first and second ends of the first and second tapered middle sleeves (136,138) being less than the inner diameter (131) of the outer cylinder (122), such that the first tapered middle sleeve (136) is positioned over the first inner sleeve (132) and inside the outer cylinder (122), at the first end of the outer cylinder (122); the second tapered middle sleeve (138) is positioned over the second inner sleeve (134) and inside the outer cylinder (122), at the second end of the outer cylinder (122); and the lengths (188) of the tapered cylindrical side portions of each of the first and second tapered middle sleeves (136,138) are individually and collectively less than the length (148) of the elongate portion of the outer cylinder (122);

with the first and second tapered middle sleeves (136, 138) each further having a respective first and second tapered annular groove (144,146) on an outer surface thereof, proximate to the outer cylinder (122), with each of the first and second annular grooves (144, 146) having a length (192) parallel to an axial length of the first and second middle sleeves (136,138), and an average depth (190) transverse to the axial length of the first and second middle sleeves (136,138) at a mid-point along the annular groove length (192);

with the first and second tapered middle sleeves (136, 138) each still further having a respective deformable first and second deflection section (172,174), with the first deflection section (172) being positioned on the first tapered middle sleeve (136) proximate to the first tapered annular groove (144) on the outer surface of the first tapered middle sleeve (136), between the first tapered annular groove (144) and the first inner sleeve (132), and with the second deflection section (174) being positioned on the second tapered middle sleeve (138) proximate to the second tapered annular groove (146) on the outer surface of the second tapered middle sleeve (138), between the second tapered annular groove (146) and the second inner sleeve (134), the deflection sections (172,174) acting to respectively receive the first and second inner sleeves (132,134) during radial expansion thereof and deform in response thereto to prevent radially outward expansive forces from the first and second inner sleeves (132,134) from being transmitted to the outer cylinder (122), and with the first and second tapered middle sleeves (136,138) each yet still further having one of a respective first and second pair of first and second circumferential end steps (176,178;180,182), with the first pair of end steps (176,178) forming part of the first tapered middle sleeve (136), such that the first pair of end steps (176,178) is defined by the first tapered annular groove (144), and such that the first end step (176) of the first pair is at the first, outer end of the first tapered middle sleeve (136) and the second end step (178) of the first pair is at the second, inner end of the first tapered middle sleeve (136), with the first deflection section (172) therebetween, and with the second pair of end steps (180,182) forming part of the second tapered middle sleeve (138), such that the second pair of end steps is defined by the second tapered annular groove (146), and such that the second end step (180) of the second pair is at the first, outer end of the second tapered middle sleeve (138) and the second end step (182) of the second pair is at the second, inner end of the second tapered middle sleeve (138), with the second deflection section (174) therebetween, such that the first pair of end steps (176,178) act to redirect outwardly radial forces transmitted thereinto by the first deflection section (172) into the outer cylinder (122), and the second pair of end steps (180,182) act to redirect outwardly radial force transmitted thereinto by the second deflection section (174) into the cylinder (122), during radial expansion of the first and second inner sleeves (132,134).

12. The printing cylinder assembly (120) according to claim 11, further comprising a hydraulically operable mandrel (126), capable of being detachably attached to the outer cylinder (122) by insertion into the first and second inner sleeves (132,134), whereby the mandrel (126) generates hydraulically developed attachment forces which actuate the hydraulic systems (185,187), thereby causing expansion of the first and second inner sleeves (132,134), deformation of the deflection sections (172,174) and transmission of the radially outward expansion forces of the first and second inner sleeves (132,134) into the end steps (176,178:180,182) and ultimately to the outer cylinder (122), which is thereby engaged and held to the mandrel (126), as long as the mandrel (126) continues to generate hydraulic attachment forces.

13. The printing cylinder assembly (120) according to claim 11, wherein the outer cylinder (122) has an analox coating (124) on the outer surface thereof.

14. The printing cylinder assembly (120) according to claim 11, wherein the first and second tapered annular grooves (144,146), respectively in the first and second tapered middle sleeves (136,138), have a higher flexibility in a radial direction transverse to a longitudinal axis along the lengths of the first and second middle sleeves (136,138), than in a direction along the longitudinal axis.

15. The printing cylinder assembly (120) according to claim 11, wherein the first and second tapered annular grooves (144,146), respectively in the first and second tapered middle sleeves (136,138), have a higher flexibility in a radial direction transverse to the lengths of the first and second tapered middle sleeves (136,138), than a flexibility in a radial direction of the respectively corresponding first and second pairs of first and second end steps (176,178;180,182), at either end of each of the first and second ends of the first and second tapered middle sleeves (36,38).

16. The printing cylinder assembly (120) according to claim 11, wherein the first and second tapered annular grooves (144,146), respectively in the first and second tapered middle sleeves (136,138), and the first and second pairs of first and second end steps (176,178;180,182), at either end of each of the first and second ends of the first and second tapered middle sleeves (136,138), have a rectangular cross section in a plane extending through a longitudinal axis along the lengths of the first and second tapered middle sleeves (136,138).

17. The printing cylinder assembly (120) according to claim 11, wherein the first tapered middle sleeve (136) is positioned inside the outer cylinder (122) in a shrink-fit reception with the inner surface of the outer cylinder (122), at the first end of the outer cylinder (122); and the second tapered middle sleeve (138) is positioned inside the outer cylinder (122) in a shrink-fit reception with the inner surface of the outer cylinder (122), at the second end of the outer cylinder (122).

18. The printing cylinder assembly (120) according to claim 11, wherein the first and second middle sleeves (136,138) are made from spring steel.

19. The printing cylinder assembly (120) according to claim 11, wherein the first and second middle sleeves (136,138) each have an axial length (140) of about 2.5 inches and a first inside diameter (160,164) of about 4.0 inches; and the first and second annular grooves (144,146) have a length (192) of about 1.25 inches and an average depth (190) of about 0.03 inch.

20. The printing cylinder assembly (120) according to claim 19, wherein the first and second deflection sections (172,174) undergo a maximum outward radial deformation of about 0.008 inch.

* * * * *